US006139264A

United States Patent [19]

Schilling

[11] Patent Number: 6,139,264

[45] Date of Patent: Oct. 31, 2000

[54] COMPRESSOR INTERSTAGE SEAL

[75] Inventor: Jan C. Schilling, Middletown, Ohio

[73] Assignee: General Electric Company, Cincinnati, Ohio

[21] Appl. No.: 09/206,505

[22] Filed: Dec. 7, 1998

[51] Int. Cl.[7] ..... F01D 11/00

[52] U.S. Cl. ..... 415/174.2; 415/174.5

[58] Field of Search ..... 277/414, 415, 277/421; 415/173.1, 173.3, 173.4, 173.5, 173.7, 174.2, 174.5, 174.4

[56] References Cited

U.S. PATENT DOCUMENTS

| | | | |
|---|---|---|---|
| 4,295,785 | 10/1981 | Lardellier | 415/174 |
| 4,526,509 | 7/1985 | Gay, Jr. et al. | 415/174 |
| 4,767,267 | 8/1988 | Salt et al. | 415/174 |
| 4,897,021 | 1/1990 | Chaplin et al. | 415/173.7 |
| 5,320,487 | 6/1994 | Walker et al. | 415/173.3 |

OTHER PUBLICATIONS

US Patent application Ser. No. 09/134,828; filed Aug. 17, 1998.

*Primary Examiner*—Edward K. Look
*Assistant Examiner*—Ninh Nguyen
*Attorney, Agent, or Firm*—Andrew C. Hess; Nathan D. Herkamp

[57] ABSTRACT

A compressor stator includes a plurality of vanes affixed to outer and inner bands. A seal includes a pair of mounting rails disposed in respective hooks in the inner band. A spring is affixed to the inner band in compression with an outboard side of the seal to load the rails in radial engagement with the hooks.

20 Claims, 3 Drawing Sheets

COMPRESSOR INTERSTAGE SEAL

BACKGROUND OF THE INVENTION

The present invention relates generally to gas turbine engines, and, more specifically, to air compressors therein.

A typical aircraft turbofan gas turbine engine includes a multistage axial compressor for sequentially pressuring air. The compressor includes a rotor having a plurality of axially spaced apart rows of compressor rotor blades extending radially outwardly therefrom. Surrounding the rotor is an annular casing from which extends radially inwardly a plurality of rows of compressor stator vanes which cooperate with respective blade rows for compressing the air in stages.

A fixed stator vane stage is typically formed in a plurality of circumferentially adjoining sectors which are removably attached to the casing. Each sector includes an arcuate outer band, an arcuate inner band, and several stator vanes extending radially therebetween. The outer band includes forward and aft rails which engage corresponding hooks or slots in the casing for mounting the sectors thereto. The inner band is suspended radially outwardly of the compressor rotor and axially between adjacent rows of rotor blades.

Since the blades sequentially pressurize the air from stage-to-stage, a differential pressure exists axially across each of the stator stages. Accordingly, an interstage seal is mounted from the inner bands and cooperates with a plurality of sealing teeth extending radially outwardly from the compressor rotor for effecting a labyrinth seal at each stator stage.

The interstage seal is typically attached to the compressor sectors by a backing strip having opposite axial rails which engage complementary hooks formed in the inner bands. A seal pad is attached to the backing strip and is typically in the form of a honeycomb for cooperating with the rotor teeth and effecting a fluid seal.

Since the compressor sections and interstage seals are fabricated assemblies, they are subject to typical manufacturing tolerances and assembly stackup. These components are typically manufactured from sheet metal which experiences variability in the assembly of the seal strips into the inner bands. The seal mounting hooks on the inner band are typically C-section sheet metal portions which are also arcuate in the circumferential direction along the sector. The corresponding rails of the backing strip must be similarly arcuate in curvature so that they may be assembled by circumferential insertion into the corresponding C-hooks.

In this arrangement, radial clearance is necessarily found between the rails and the mounting hooks to permit sliding assembly therebetween without excessive friction. This clearance, however, leads to vibratory wear during operation which can adversely affect the useful life. Furthermore, manufacturing differences in curvature of the rails and the mounting hooks effect point contacts therebetween which localize wear and decrease friction damping during operation.

In one design, the mounting hooks are crimped at several locations after assembly of the seal to the inner band for reducing the clearances therebetween and to increase friction damping. However, the sheet metal components have inherent resiliency which prevents the complete elimination of clearance therebetween even after the crimping operation. And, disassembly requires opening the crimps, which results in local damage.

Furthermore, since the seal is subject to occasional rubs by the rotor seal teeth during operation, suitable stops are provided in the inner band to prevent circumferential rotation of the seal segments therein. In one design, one of the circumferential ends of the C-hooks is crimped to effect such a stop. Rub reaction loads are therefore concentrated at these individual stops which increases the stress thereat.

The inherent looseness of the seal in the inner band, and vibratory and rub loads at local contact points cause associated wear thereat which can significantly reduce the useful life of the seal, or sector, or both. Accordingly, it is desired to provide an interstage seal having an improved mounting to the compressor stators for reducing wear and increasing damping thereof.

BRIEF SUMMARY OF THE INVENTION

A compressor stator includes a plurality of vanes affixed to outer and inner bands. A seal includes a pair of mounting rails disposed in respective hooks in the inner band. A spring is affixed to the inner band in compression with an outboard side of the seal to load the rails in radial engagement with the hooks.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
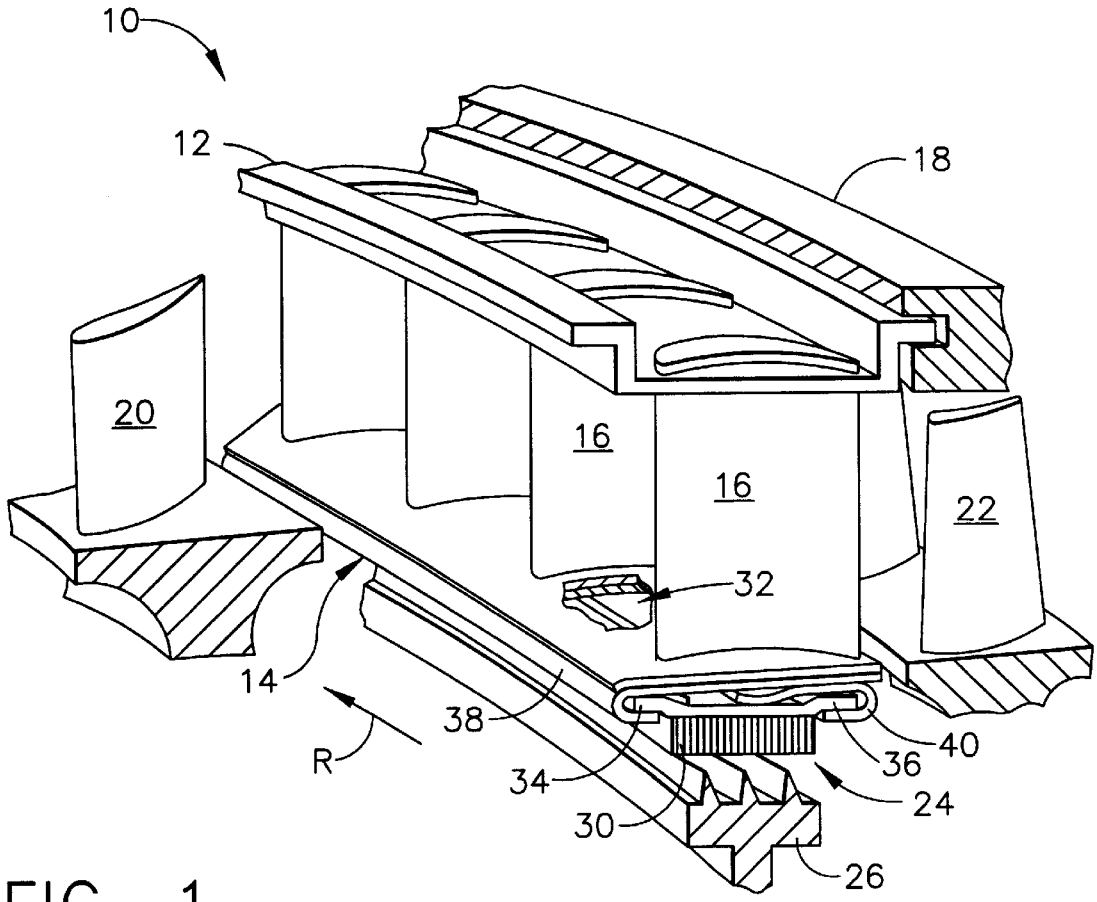
FIG. 1 is an isometric view of a portion of a compressor stator sector supporting an interstage seal in accordance with an exemplary embodiment of the present invention mounted between rotor stages.

Illustrated in FIG. 1 is a portion of an annular compressor stator 10 of a gas turbine engine. The stator 10 is typically formed in a plurality of circumferentially adjoining sectors, with each sector including an arcuate radially outer band 12 and a corresponding arcuate radially inner band 14 spaced inwardly therefrom between which extend a plurality of circumferentially spaced apart compressor stator vanes 16 suitably attached to the corresponding bands. For example, the inner band may be formed of two rolled sheets of metal brazed together and to the inner ends of the vanes.

The outer band 12 has forward and aft rails which engage corresponding hooks or slots in an annular outer casing 18, shown in part, from which the compressor stator is suspended.

The individual vanes 16 are fixedly attached to the outer and inner bands and define one of several compressor stator stages which cooperate with an upstream row of compressor rotor blades 20 and a downstream row of rotor blades 22. The rotor blades 20,22 extend radially outer from corresponding rotor disks which are powered by a turbine (not shown) for compressing air sequentially from stage-to-stage of the multistage compressor.

Since air pressure increases from stage-to-stage in the compressor, an interstage seal 24 is configured and mounted in accordance with a preferred embodiment of the present invention to the inner band 14 for sealing the inboard side of the inner band 14 between the adjacent upstream and downstream rotor stages. The interstage seal 24 cooperates with an interstage seal ring 26 which rotates with the rotor blades 20,22 during operation. In particular, the seal 24 cooperates with a plurality of seal teeth extending radially outwardly from the ring 26 to define a labyrinth seal between adjacent rotor stages.

Figure 2:
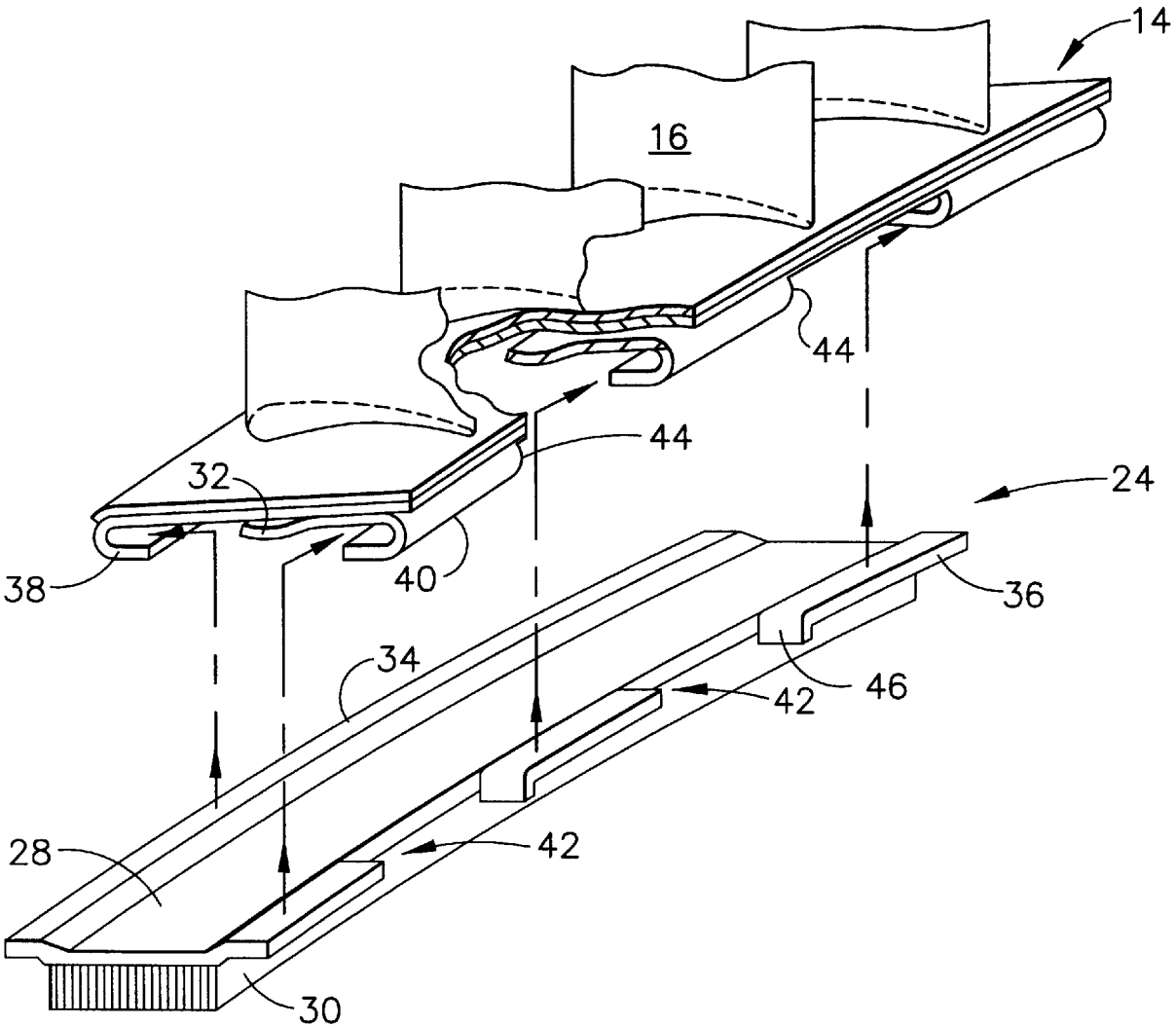
FIG. 2 is an exploded view of the compressor sector illustrated in FIG. 1 showing assembly of the seal into the inner band thereof.

The interstage seal 24 is illustrated installed in FIG. 1 and in exploded view in FIG. 2 for clarity of presentation. The seal 24 includes an arcuate backing strip 28 which is preferably sheet metal. A seal pad 30 is fixedly bonded or otherwise attached to a radially inboard side of the strip, and is typically a metallic honeycomb which cooperates with the rotor teeth for effecting the fluid seal.

The seal 24 cooperates with a leaf spring 32 which is fixedly attached to the inner band 14, and is configured in accordance with a preferred embodiment of the present invention for being resiliently compressed in abutting engagement with the outboard side of the backing strip to completely eliminate radial stackup clearance therebetween.

As shown initially in FIG. 2, the backing strip 28 includes a pair of arcuate mounting rails 34,36 extending circumferentially along opposite forward and aft axial sides thereof. The forward and aft rails 34,36 are configured for slidingly mounting the seal to complementary C-hooks 38,40 in the compressor stator. The inner band 14 is preferably also made of sheet metal, with the forward hook 38 being a portion thereof, and the aft hook 40 being a separately attached sheet metal member fixedly joined thereto by brazing for example. The hooks 38,40 are formed by bending to include complementary C-shaped slots therein which extend circumferentially for circumferentially receiving the corresponding rails 34,36 during assembly.

A particular advantage of the leaf spring 32 is its ability to exert a radially inwardly directed force F when compressed against the backing strip 28, with corresponding reaction forces being effected between the rails 34,36 and the radially inner legs of the hooks 38,40. Irrespective of the radial clearances between the rails in their corresponding hooks, the leaf spring 32 is compressed during assembly to tightly position the rails against the hooks. This eliminates looseness in the assembled interstage seal and permits ready assembly and disassembly of the components, and without the need for mechanical crimping.

Furthermore, the spring frictionally engages the rails and hooks for providing vibratory damping during operation. And, the friction fit between the rails and hooks also provides secondary seals at these locations, with the leaf spring 32 itself also providing a secondary seal against the backing strip 28.

In a preferred embodiment, each stator sector includes a single leaf spring 32 which is circumferentially continuous along the inboard surface of the inner band between the two circumferentially opposite ends of the sector. The spring is integrally formed with the aft hook 40 in a one-piece sheet metal construction. In this construction, the proximal end of the spring defines the upper leg of the aft hook 40, with the distal end of the spring extending axially forwardly therefrom in a cantilevered construction which permits resilient compression thereof upon insertion of the seal 24 in the corresponding hooks.

As indicated above in the background section, a conventional interstage seal is assembled in the inner band by circumferentially inserting the mounting rails through the corresponding circumferential ends of the supporting hooks. Sufficient radial clearance must be provided between the rails and hooks to allow the complete insertion of the rails without obstruction or excessive friction. A typical compressor stator may have about six or more circumferential stator sectors which collectively define a complete annular ring. The corresponding rails and hooks are typically continuous along their circumferential length, and upon assembly thereof the rails and hooks are coextensive.

In a basic embodiment of the present invention, the rails 34,36 and hooks 38,40 may both be circumferentially continuous in each sector, with the leaf spring 32 being resiliently compressed against the outboard surface of the backing strip 28 as the seal is circumferentially inserted in the inner band. However, the spring force F necessarily increases friction between the spring and the backing strip, as well as friction between the corresponding rails and hooks which may substantially increase the amount of insertion force required for sliding the seal to its final circumferential position coextensive with the circumferential extent of the inner band.

The snug friction fit of the seal in its mounting hooks is desirable for reducing secondary leakage between the rails and hooks, but increases the difficulty of assembly. An even tighter fit of the rails in their hooks can further reduce secondary leakage therebetween and may be effected by modifying one or more of the rails and their corresponding hooks in another embodiment of the present invention as initially shown in FIG. 2. In this embodiment, the aft rail 36 includes one or more edge notches 42 which are open in the axially aft direction and separate the aft rail 36 into a corresponding plurality of discrete rail tabs.

The rail tabs 36 are arcuate and circumferentially aligned with each other for matching the circumferential profile of the corresponding aft hook 40 in which they are mounted.

The aft rail tabs 36 cooperate with the complementary aft hook 40 specifically configured therefor. As shown in FIG. 2, the aft hook 40 includes a corresponding number of radially inwardly facing notches 44 in the inner leg thereof which separate the aft hook into a plurality of circumferentially spaced apart tabs. Each of the hook notches 44 is sized in circumferential length to radially receive a corresponding one of the rail tabs 36. This permits assembly of the seal in the inner band with a substantially reduced amount of circumferential sliding or twisting.

As shown in FIG. 2, the seal 24 is initially radially assembled into the inner band 14 with the aft tabs 36 aligned in respective ones of the hook notches 44. The seal may then be translated axially forwardly for engaging the forward rail 34 into the corresponding forward hook 38 of the inner band. The seal 24 is then rotated circumferentially for engaging the corresponding aft rail tabs 36 in the respective portions of the aft hook 40, which leaves the aligned notches 42,44 substantially empty as shown in FIG. 3.

In this way, the amount of required circumferential twisting of the seal 24 for insertion into the inner band is substantially reduced. The notched aft rail 36 and corresponding notched aft hook 40 collectively define a bayonet mount in which the rail tabs 36 may enter the aft hook through the corresponding hook notches 44, and upon circumferential twisting of the seal, the rail tabs are radially trapped atop the hook tabs in the respective slots therein.

In the exemplary embodiment illustrated in FIG. 2, three aft rail tabs are disclosed with two of the tabs being received in two hook notches 44 during assembly with the third rail tab entering the inner band from one of its circumferential ends. Assembly twisting of the seal 24 merely requires circumferential travel along the corresponding length of the individual hook tabs which is a substantial fraction of the entire circumferential length of the inner band 14.

Figure 3:
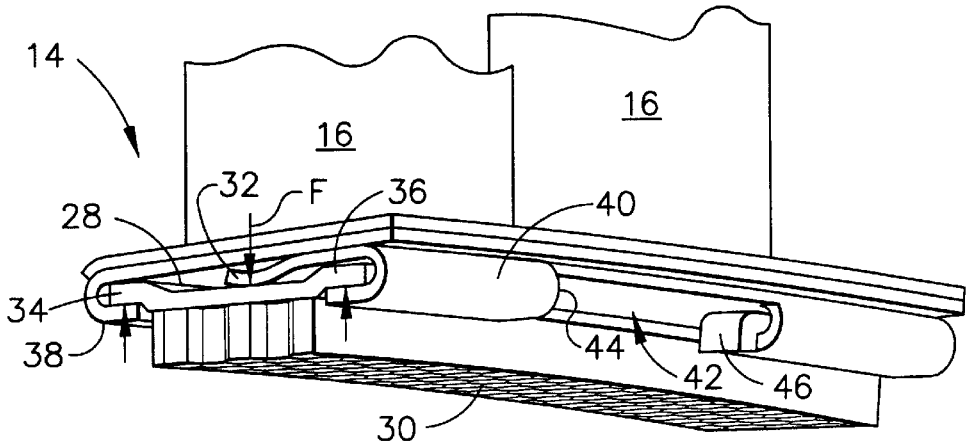
FIG. 3 is an enlarged, isometric view of a portion of the seal illustrated in FIG. 1 after final assembly in the inner band of the compressor sector.

A particular advantage of the bayonet mount illustrated in FIGS. 2 and 3 is that the radial clearances required between the rails and their corresponding hooks may be substantially reduced over that required where the rails would otherwise be inserted from a single end of the inner band and slid along the entire circumferential length thereof. For example, the slot defined by the forward hook 38 illustrated in FIG. 3 may have a radial thickness sized to substantially match the radial thickness of the forward rail 34, with substantially little clearance therebetween, less than about 0.075 mm for example.

Since the forward rail 34 and its mating hook slot extend primarily only in the axial direction, the bayonet mount permits the forward hook 38 to axially receive the forward rail 34 without radial tilting of the seal even though the tight radial clearance is provided between the forward rail and hook. In this way, a substantially tighter fit between the forward rail 34 and its mating hook 38 may be effected, without the corresponding increase in friction therebetween preventing complete assembly of the seal to the inner band. Since the inner seal requires only partial circumferential twisting to engage the aft rail tabs behind the corresponding aft hook tabs, the initially higher twisting force may be readily overcome.

Furthermore the radial clearance between the aft rail and aft hook my also be minimized for further improving the secondary sealing therebetween. This secondary sealing is affected in conjunction with the additional sealing provided by the abutting leaf spring 32 atop the backing strip 28.

As shown in FIG. 1, the seal pad 30 is mounted in close proximity to the seal teeth on the ring 26 and is therefore subject to occasional rubbing therebetween as the ring 26 rotates in the counterclockwise direction R indicated. In the event of such a rub, frictional rub forces are carried through the seal pad 30 and in turn through the corresponding rails 34,36 into the inner band.

As show in FIG. 2, at least one of the aft rail tabs 36 may include a lip 46 extending radially inwardly therefrom at a trailing edge thereof. The lip 46 may be an integral portion of the rail tab simply formed by bending thereof.

Upon assembly as illustrated in FIG. 3, the lip 46 circumferentially abuts a corresponding end of the respective aft hook tab which prevents further circumferential movement of the backing strip in that direction. In this way, one or more of the lips 46 may be provided to limit or stop the circumferential movement of the backing strip in the inner band, and are also effective for preventing circumferential movement of the backing strip during the occasional seal rub.

Another significant advantage of the present invention is that the individual seals 24 may be readily disassembled from the inner bands by reversing the assembly process, which permits simple replacement of the seals as they become worn during use. Assembly and disassembly of the seals in the corresponding inner bands does not require any mechanical deformation or crimping of the inner band, as was previously done in the art for reducing vibratory wear and insuring a tight fit. Instead, the integral leaf spring 32 and bayonet mount permit assembly of the seal in the inner band notwithstanding the tight fit therebetween for minimizing secondary leakage and maximizing frictional damping.

Figure 4:
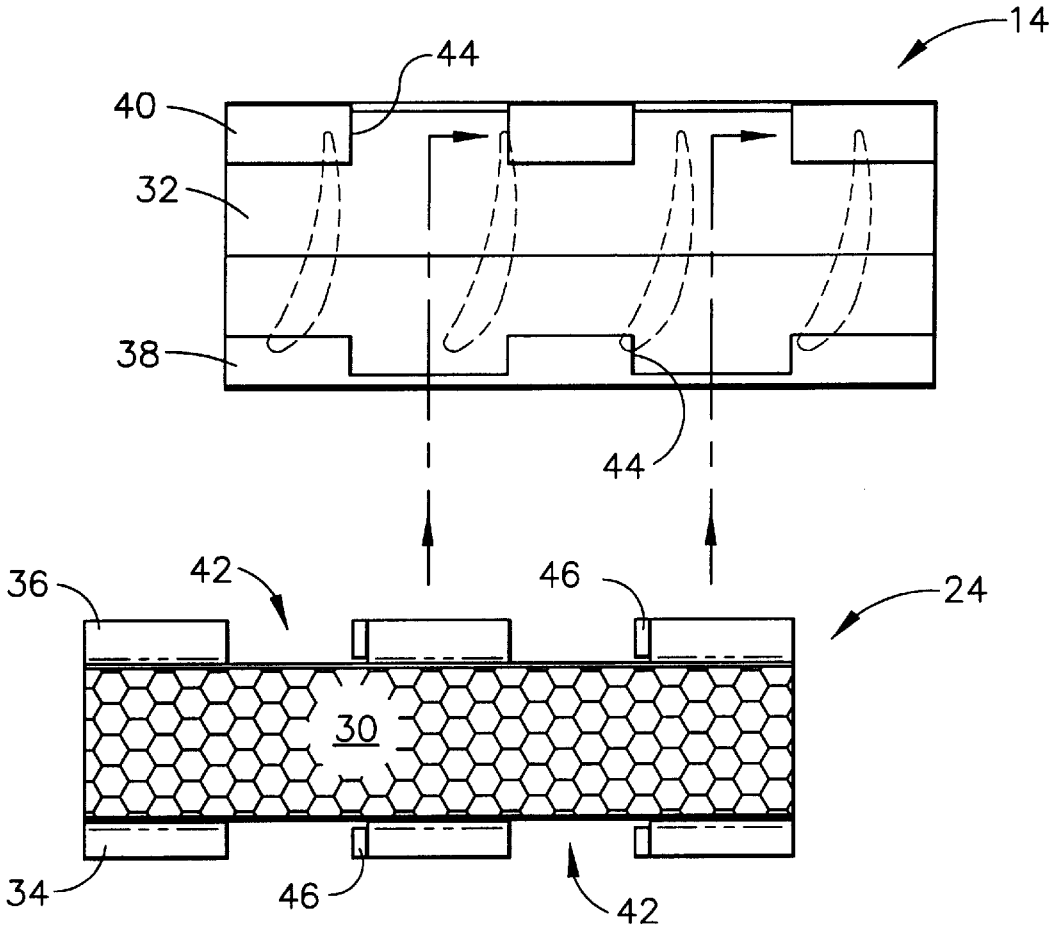
FIG. 4 is an exploded, bottom plan view of a seal and cooperating inner band in accordance with another embodiment with the present invention.

In yet another embodiment of the present invention illustrated in FIG. 4, both the forward and aft hooks 38,40 may include the hook notches 44 therein. And, both the forward and aft rails 34,36 may include the rail notches 42 therein for defining a double bayonet mount along the forward and aft edges of the inner band 14.

One advantage of this embodiment is that the seal 24 may be assembled into the inner band 14 initially with radially only alignment of the corresponding rail tabs in the hook notches without the need for the additional axial translation of the forward rail 34 into the forward hook 38 in the embodiment illustrated in FIG. 2. After the rail tabs are inserted in the hook notches, the seal may be simply circumferentially rotated to engage the rail tabs behind respective ones of the hook tabs for completing assembly. The stop lips 46 may be provided on both forward and aft rail tabs to distribute the occasional rub loads therebetween.

In the preferred embodiment illustrated in FIG. 1, the forward hook 38 remains circumferentially continuous without mounting notches therein to ensure an aerodynamically smooth leading edge of the inner band 14.

The spring-loaded, bayonet mounted, interstage seal 24 provides significant advantages in both assembly and disassembly without deformation or damage to the inner band 14 itself. The leaf spring 32 maintains positive engagement of the rails in their corresponding hooks and reduces secondary leakage therebetween. The leaf seal itself also provides secondary sealing with the outer surface of the backing strip, as well as compression force thereat and corresponding reaction forces at the two rails for providing enhanced frictional damping during operation. The rail tabs permit the simple addition of the stop lips to prevent over-travel of the backing strip in the inner band during assembly and seal rubs.

Accordingly, what is desired to be secured by Letters Patent of the United States is the invention as defined and differentiated in the following claims in which I claim:

1. A compressor stator comprising:

an arcuate outer band;

an arcuate inner band spaced radially inwardly from said outer band, and including a pair of hooks;

a plurality of stator vanes affixed to said outer and inner bands;

a seal having a pair of mounting rails extending circumferentially along opposite sides thereof, and disposed in respective ones of said hooks; and a spring integrally formed with a first one of said hooks, and compressed in engagement with an outboard side of said seal to load said rails in radial engagement with said hooks.

2. A stator according to claim 1 wherein said spring extends circumferentially along said inner band and axially between said hooks.

3. A stator according to claim 2 wherein said spring is cantilevered from said first hook.

4. A stator according to claim 2 wherein said seal comprises:

an arcuate backing strip having said rails extending circumferentially along opposite sides thereof;

a seal pad affixed to an inboard side of said strip between said rails; and a first one of said rails includes a notch defining a plurality of rail tabs.

5. A compressor stator comprising:

an arcuate outer band;

an arcuate inner band spaced radially inwardly from said outer band, and including a pair of hooks, and a first one of said inner band hooks includes a notch defining a plurality of hook tabs;

a plurality of stator vanes affixed to said outer and inner bands;

a seal having a air of mounting rails extending circumferentially along opposite sides thereof, and disposed in respective ones of said hooks, and a first one of said rails includes a notch defining a plurality of rail tabs, and said hook notch is sized to receive a corresponding one of said rail tabs for circumferential sliding thereof atop a respective one of said hook tabs to define a bayonet mount; and a spring affixed to said inner band and compressed in engagement with an outboard side of said seal to load said rails in radial engagement with said hooks.

6. A stator according to claim 5 wherein said rail tabs are circumferentially aligned, and at least one of said rail tabs includes a lip extending radially therefrom to circumferentially abut a respective one of said hook tabs.

7. A stator according to claim 6 wherein:

a second one of said hooks includes a slot sized in thickness to substantially match a thickness of a second one of said rails for axially receiving said second rail without radial tilting.

8. A stator according to claim 6 wherein both said hooks include said hook notches therein, and both said rails include said rail notches therein for allowing assembly thereof without axial movement of said rail tabs in said hooks.

9. A stator according to claim 6 wherein said spring is circumferentially continuous along said inner band.

10. An interstage seal for a compressor stator comprising:

an arcuate backing strip having a pair of mounting rails extending circumferentially and axially coextensively along opposite sides thereof;

a seal pad affixed to an inboard side of said strip between said rails; and a first one of said rails includes a notch defining a plurality of axially coextensive rail tabs.

11. A seal according to claim 10 wherein said rail tabs are circumferentially aligned, and at least one of said rail tabs includes a lip extending radially therefrom.

12. A seal according to claim 11 wherein both of said rails include respective ones of said notches to define respective tabs.

13. A compressor stator comprising:

an arcuate outer band;

an arcuate inner band spaced radially inwardly from said outer band, and including a pair of sheet metal hooks;

a plurality of stator vanes affixed to said outer and inner bands;

a seal having a pair of mounting rails extending circumferentially along opposite sides thereof, and disposed in respective ones of said hooks; and a sheet metal spring integrally formed with a first one of said hooks, and compressed in engagement with an outboard side of said seal to load said rails in radial engagement with said hooks.

14. A stator according to claim 13 wherein said spring extends circumferentially along said inner band and axially between said hooks, and is cantilevered from said first hook.

15. A stator according to claim 14 wherein said seal comprises:

an arcuate backing strip having said rails extending circumferentially along opposite sides thereof;

a seal pad affixed to an inboard side of said strip between said rails; and a first one of said rails includes a notch defining a plurality of rail tabs.

16. A stator according to claim 15 wherein:

said first hook includes a notch defining a plurality of hook tabs;

said hook notch is sized to receive a corresponding one of said rail tabs for circumferential sliding thereof atop a respective one of said hook tabs to define a bayonet mount; and said rail tabs are circumferentially aligned, and at least one of said rail tabs includes a lip extending radially therefrom to circumferentially abut a respective one of said hook tabs.

17. A stator according to claim 16 wherein:

a second one of said hooks includes a slot sized in thickness to substantially match a thickness of a second one of said rails for axially receiving said second rail without radial tilting.

18. A stator according to claim 16 wherein both said hooks include said hook notches therein, and both said rails include said rail notches therein for allowing assembly thereof without axial movement of said rail tabs in said hooks.

19. A method of assembling said stator according to claim 16 comprising:

radially inserting said seal into said inner band, with said one rail tab aligned in said hook notch; and circumferentially rotating said seal for engaging said first rail in said first hook.

20. A method according to claim 19 further comprising:

axially translating said seal for engaging said second rail in said second hook after said radial insertion and prior to said circumferential rotation; and then circumferentially rotating said seal to engage said first rail and first hook.

* * * * *